US006812902B2

(12) United States Patent
Rossman et al.

(10) Patent No.: US 6,812,902 B2
(45) Date of Patent: Nov. 2, 2004

(54) LOW PROFILE TWO-ANTENNA ASSEMBLY HAVING A RING ANTENNA AND A CONCENTRICALLY-LOCATED MONOPOLE ANTENNA

(75) Inventors: Court Emerson Rossman, Scotts Valley, CA (US); Brian George St. Hilaire, San Jose, CA (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 26 days.

(21) Appl. No.: 10/249,660

(22) Filed: Apr. 29, 2003

(65) Prior Publication Data

US 2003/0210193 A1 Nov. 13, 2003

Related U.S. Application Data

(60) Provisional application No. 60/380,444, filed on May 13, 2002.

(51) Int. Cl.[7] ..... H01Q 21/00

(52) U.S. Cl. ..... 343/725; 343/700 MS; 343/728

(58) Field of Search ..... 343/700 MS, 725, 343/727, 729, 728, 825, 846, 895

(56) References Cited

U.S. PATENT DOCUMENTS

| | | | | | |
|---|---|---|---|---|---|
| 4,864,320 | A | * | 9/1989 | Munson et al. | 343/833 |
| 5,300,936 | A | * | 4/1994 | Izadian | 343/700 MS |
| 5,864,318 | A | * | 1/1999 | Cosenza et al. | 343/700 MS |
| 6,160,512 | A | * | 12/2000 | Desclos et al. | 343/700 MS |
| 6,188,366 | B1 | * | 2/2001 | Yamamoto et al. | 343/722 |
| 6,285,341 | B1 | | 9/2001 | Roscoe et al. | 343/895 |
| 6,339,406 | B1 | | 1/2002 | Nesic et al. | 343/797 |

* cited by examiner

*Primary Examiner*—Tho Phan
(74) *Attorney, Agent, or Firm*—Holland & Hart LLP

(57) ABSTRACT

A disk-shaped two-antenna assembly contains a CP ring-antenna and a linear-monopole-antenna. The bottom surface of a ring-shaped dielectric member holds a ground plane. A circular radiating element is located on a top surface of the ring-shaped dielectric member. A linear radiating element is positioned coincident with a central axis of the two-antenna assembly, and a top end thereof carries a metal disk that extends perpendicular to the central axis of the two-antenna assembly. A centrally-located void lies between the ground plane and the metal disk to provide for the housing of electronic components. Metal RF shields are electrically connected to the ground plane and are located at the top portion of this void, intermediate the bottom-located ground plane and the top-located metal disk.

59 Claims, 7 Drawing Sheets

LOW PROFILE TWO-ANTENNA ASSEMBLY HAVING A RING ANTENNA AND A CONCENTRICALLY-LOCATED MONOPOLE ANTENNA

CROSS REFERENCE TO RELATED APPLICATIONS

This non-provisional patent application claims the benefit of U.S. Provisional Patent Application Ser. No. 60/380,444, entitled "LOW PROFILE TWO-ANTENNA ASSEMBLY HAVING A RING ANTENNA AND A CONCENTRICALLY-LOCATED MONOPOLE ANTENNA" filed by Court E. Rossman on May 13, 2002, incorporated herein by reference.

BACKGROUND OF INVENTION

1. Field of the Invention

This invention relates to the field of wireless communication, and more specifically to antennas for radiating and receiving both circular polarized (CP) and linear polarized electromagnetic signals, for example signals that are used in satellite communication systems.

2. Description of the Related Art

Mobile satellite communication systems create a need for low profile and compact antennas. For example, satellite radio systems include both satellite transmitters and terrestrial or land-based transmitters, and mobile antennas that are used in these satellite radio systems are required to receive both satellite transmitted signals and terrestrial transmitted signals. In addition, this signal redundancy must be designed into the system so that there will be few geographic regions providing gaps in coverage across the country.

Terrestrial signals are much stronger than satellite signals. However, in order to be economical, terrestrial transmitters are usually placed around large metropolitan centers, since it is cost prohibitive to place terrestrial transmitters in relatively unpopulated regions of the country. However, satellite signals are provided virtually everywhere, and such signals are required for regions of the country that do not receive terrestrial transmitted signals.

A low profile satellite antenna is desired for automotive applications due to obstacles that such an antenna may encounter, for example soccer balls, rollers that are within a car wash, and items that may be temporarily mounted on the roof of the automobile.

A low profile automobile antenna is also desired because such an antenna can be easily factory-installed, and the antenna runs less risk of being damaged before arriving at an auto dealership. An additional reason favoring low profile automobile antennas is their relatively pleasing appearance, and the fact that low profile antennas do not generally suppress visibility.

In the example of a satellite radio system, it is a technical challenge to fit desired antenna functions within a single, low profile and compact antenna assembly for mounting on the top of an automobile.

A low profile CP patch antenna is usually not adequate to serve as a satellite antenna, unless the automobile is located relatively close to the equator. The directivity of a patch antenna that is located over a large ground plane is usually over 5 dB when the antenna points directly up.

From the vantage point of geographic areas within the United States, geo-stationary satellites are located predominantly between 20 and 60 degrees off of the southern horizon. Hence, signals that are received from a geo-stationary satellite using a CP patch antenna are weak signals.

A solution to providing a satellite antenna is a quadrifilar helix antenna. FIG. 1 shows a standard-technology antenna 10 having both a quadrifilar helix 11 and a concentrically-located monopole 12. Quadrifilar helix antenna 11, when fed in quadrature, generates an omni CP depressed cardioid pattern, which is an omni pattern with a moderate (i.e. a few dB) dip in gain at zenith. Monopole antenna 12 generates a linear omni pattern. Coupling between CP quadrifilar helix antenna 11 and monopole antenna 12 can be reduced by placing the monopole antenna 12 in the geometric center of helix antenna 11.

Quadrifilar helixes 11 as shown in FIG. 1 are typically over two wavelengths tall, this height being required in order to generate a depressed cardioid pattern. As can be seen from FIG. 1, such an antenna does not have a low profile, and such an antenna is not physically compact.

A lower profile standard-technology antenna is a crossed dipole antenna, wherein the dipole must be ⅜ wavelength or more above a ground plane in order to generate a depressed cardioid pattern. If the dipoles of such an antenna are closer to the ground plane, directivity of the antenna is too large, and the antenna pattern is similar to that of the CP patch antenna described above.

FIG. 2 shows a standard-technology droopy crossed dipole antenna 13 having four combined monopoles 14 that are fed 90 degrees out of phase in order to generate CP radiation. The four meanderline monopoles 14 of FIG. 2 are fed in phase and they are combined underneath the antenna with a feed network (not shown), to thus provide a single linear monopole pattern. Monopoles 14 of FIG. 2 can be straight wires, they can be planar inverted-F antennas (PIFAs), or they can be top loaded monopoles, all of which create the same radiation.

Coupling between the crossed dipoles 15 of FIG. 2, and feed to monopoles 14, is ideally zero because coupling to each of the four monopoles 14 is in quadrature, and this coupling cancels at the input to the antenna's feed network. However, the ⅜ wavelength height that is required in antenna 13 does not provide a low profile antenna for mounting on the top of an automobile.

Low profile antennas that generate a conical CP pattern and that have a deep null at zenith, instead of a depressed cardioid pattern, are available. FIG. 3 shows a standard-technology ring antenna 16 that operates in $TM_{21}$ mode, antenna 16 having a field coupling feed 17 and a single mode separator 18 that is located at 22.5 degrees from feed 17 (see H. Hakano, K. Fujimori, J. Yamauchi, "A LOW-PROFILE CONICAL BEAM LOOP ANTENNA WITH AN ELECTROMAGNETICALLY COUPLED FEED SYSTEM," IEEE Trans. On Ant. And Prog., Vol 48, No. 12, December 2000).

One problem in providing a low profile antenna is that of antenna bandwidth. Bandwidth typically is proportional to the distance between the antenna radiating/receiving element(s) and the antenna ground plane; i.e., the volume of the antenna (see Chu, L. j., "PHYSICAL LIMITATIONS OF OMNI-DIRECTIONAL ANTENNAS", J. Appl. Phys, Vol 19, December 1948, pp. 1163–1175). Hence, it is advantageous to provide that the radiating/receiving element (herein after radiating element) of a low profile antenna be at the greatest distance above the ground plane as is possible, while still satisfying the low profile requirement.

SUMMARY OF INVENTION

This invention provides a thin, disk-shaped, two antenna assembly for use in radiating and receiving both CP and linear electromagnetic signals of the type usually used in satellite communication systems.

In accordance with the invention, a CP ring antenna and a top-loaded monopole antenna occupy a common disk-shaped, or cylindrical-shaped, volume that has a generally flat bottom surface generally parallel to a flat top surface.

A ring-shaped radiating element of the ring antenna and the top loading disk of the monopole radiating element occupy a common plane at, or adjacent to, the generally top flat surface of this disk-shaped volume. That is, the radiating element of the ring antenna and the radiating disk of the monopole antenna may be generally coplanar.

The generally flat bottom surface of this disk-shaped volume includes a metal ground plane that may be carried by the bottom surface of a generally flat printed circuit board (PCB). In use, it is intended that antenna assemblies in accordance with the invention be physically oriented such that the ground plane is located in a generally horizontal plane.

The top-loaded monopole antenna (which may comprise two parallel and vertically extending metal posts) is located approximately concentric within the ring antenna in order to minimize electromagnetic coupling between the monopole antenna and the ring antenna. The top-loaded monopole antenna is physically supported by the PCB, and an air dielectric is associated with the monopole antenna.

Electronic components that are used by the monopole antenna and/or the ring antenna are located within a ring-shaped void that exists between a dielectric ring whose top surface supports the ring antenna. These electronic components may be mounted on the top surface of the ground plane at a location that is under the radiating ring of the ring antenna and under the top-loading disk of the monopole antenna.

The metal ring of the ring antenna may be in the form of meandering metal line that forms a circle, or it may be in the form of a wide or a narrow metal line that forms a circle. Metal perturbations or mode separators cooperate with this metal ring in order to preserve the symmetry of the ring antenna and in order to retain a symmetrical radiation pattern for the ring antenna.

At least one metal feed post is provided for the metal ring of the ring antenna and at least one generally centrally located metal post forms the monopole radiating element.

DESCRIPTION OF THE PREFERRED EMBODIMENTS

Without limitation thereto, embodiments of antennas in accordance with this invention operate at 2.33 GHz, i.e. the frequency of interest for current satellite radio communications. This constraint provides a way to compare dimensions of different antennas, wherein the dimensions can also be compared to wavelength. However, antennas in accordance with the invention can be scaled to size to radiate at any frequency.

Figure 1:
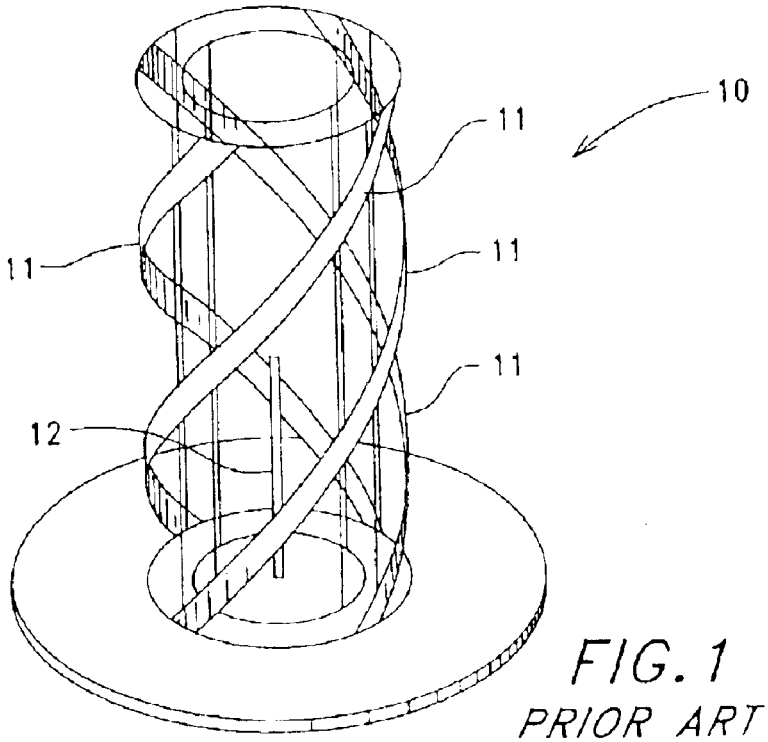
FIG. 1 PRIOR ART
FIG. 1 shows a standard-technology antenna having both a quadrifilar helix and a concentrically-located monopole.
Figure 2:
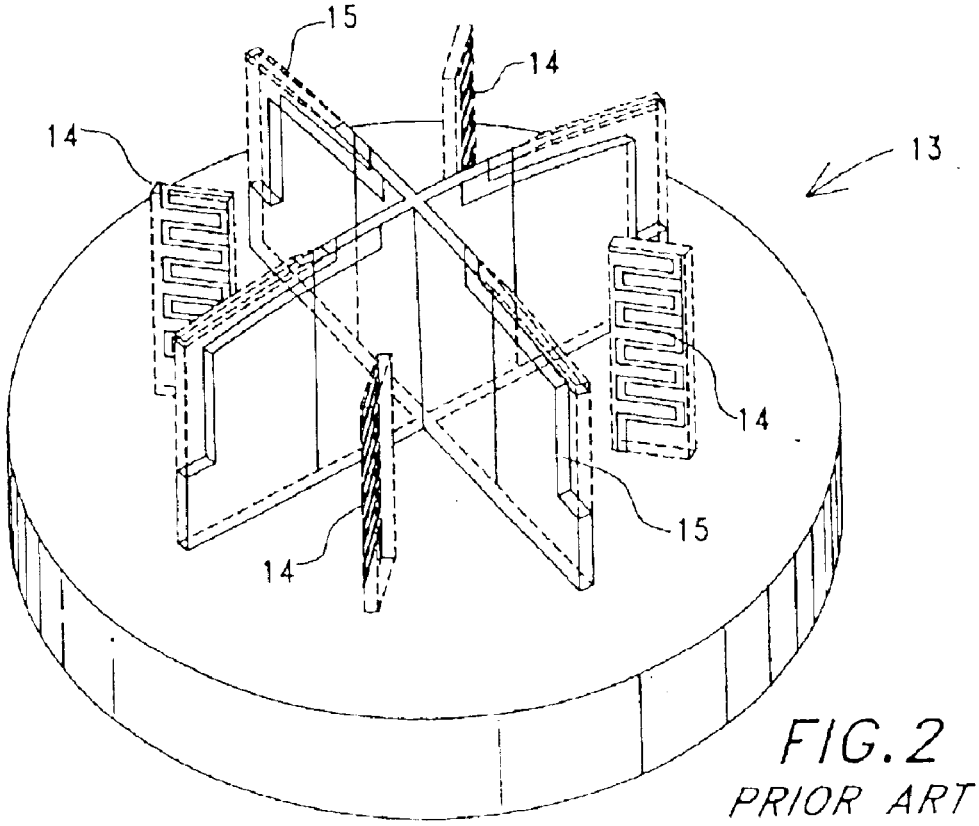
FIG. 2 PRIOR ART
FIG. 2 shows a standard-technology droopy crossed dipole antenna having four combined monopoles that are fed 90 degrees out of phase in order to generate CP radiation.
Figure 3:
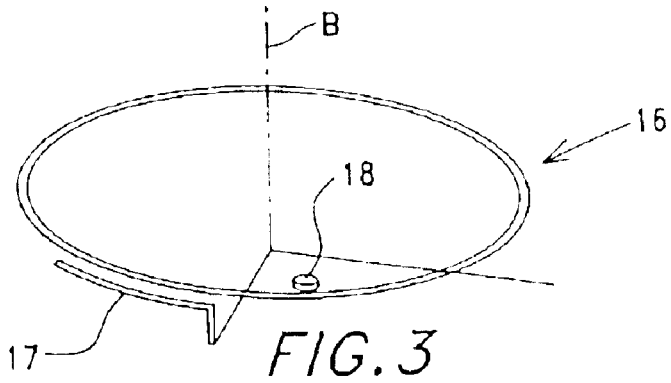
FIG. 3 PRIOR ART
FIG. 3 shows a standard-technology ring antenna that operates in $TM_{21}$ mode, the antenna having a field coupling feed and a single mode separator that is located at 22.5 degrees from the feed.
Figure 4:
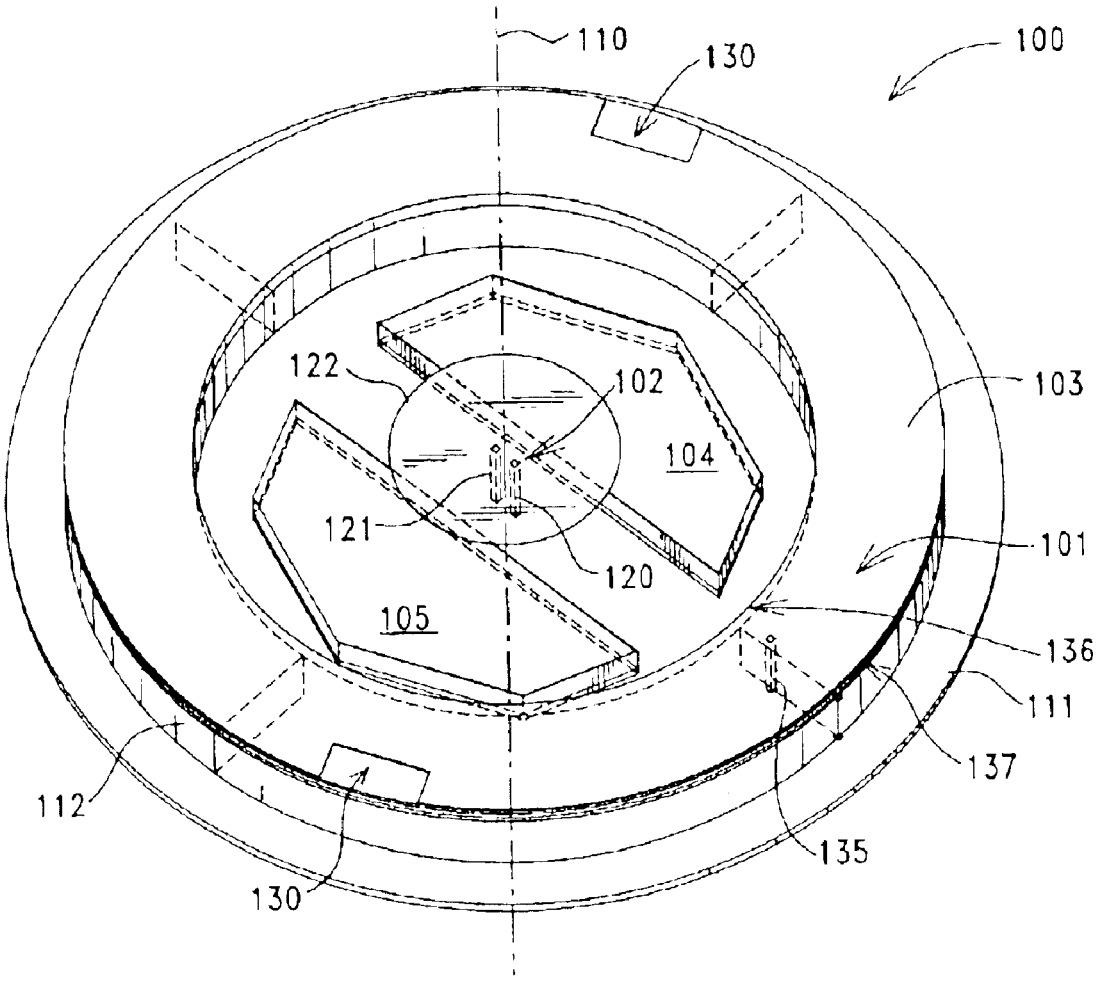
FIG. 4 shows a disk-shaped, two antenna assembly in accordance with the invention that includes a ring antenna and a linear monopole antenna that is located concentrically within the ring antenna, wherein the ring antenna's radiating element comprises a wide-trace, non-meanderline, circle or ring-shaped metal pattern, and wherein the top portion of the antenna assembly includes two centrally-located and half-octagonal metal shields that are electrically connected to the assembly's ground plane and that operate to shield electronic components that are contained within an open volume of the antenna assembly at a location that is under the two metal shields.

FIG. 4 shows a thin and disk-shaped two antenna assembly 100 in accordance with the invention that includes a ring antenna 101 and a linear monopole antenna 102 that is located concentrically within ring antenna 101. Monopole antenna 102 can be characterized as a terrestrial top-loaded metal disk monopole antenna that is shunt matched.

The ring antenna's radiating element 103 comprises a wide-trace, non-meanderline, ring-shaped metal pattern. The top portion of antenna assembly 100 includes two centrally-located and half-octagonal metal shields 104 and 105 that operate to shield electronic components (not shown) that are contained within a volume of antenna assembly 100 that is under metal shields 104, 105.

Monopole antenna 102 is made up of two generally parallel metal radiating elements 120 and 121 whose top ends support a metal disk 122.

Antenna assembly 100 occupies a thin disk-shaped or cylindrical volume having a central axis 110, a height (see dimension 23 of FIG. 50 and an outer diameter (OD) (see dimension 37 of FIG. 5) wherein the height dimension is much smaller than the OD. By way of a non-limiting example the height dimension of antenna assembly 100 is about 8 millimeters (mm), whereas its OD is about 75 mm.

The cylindrical volume that is occupied by antenna assembly 100 has a generally planar bottom surface that includes metal ground plane 111 and a generally planar top surface that is generally parallel to ground plane 111. This cylindrical volume can be divided into three sub-volumes.

The first sub-volume of antenna assembly 100 is a ring-shaped volume having an inner diameter (ID) and an OD, whose lower surface comprises a ring-shaped portion of metal ground plane 111, whose middle portion comprises a ring-shaped dielectric ring 112, and whose upper surface contains the ring-shaped metal radiating element 103 of ring antenna 101.

It will be noted that in the FIG. 4 embodiment of the invention the diameter of ground plane 111 is somewhat greater than the diameter of ring-shaped dielectric ring 112. The diameter of ground plane 111 can be made generally 20 percent greater than the diameter of ring-shaped dielectric ring 112, as it is in other embodiments of the invention that will be described.

In an embodiment of the invention ground plane 111 extended beyond the OD of ring-shaped dielectric ring 112 an amount that is at least equal to the height of dielectric ring 112, in order to contain the antenna's fringe E fields, and in order to allow antenna 100 to not vary in tuning on and off of a larger ground plane. An optimal size for ground plane 111 is discussed below.

Dielectric ring 112 may be formed of a continuous ring of dielectric material, or it can be formed of four 90-degree segments as is shown in FIG. 4. The plastic an dielectric material of dielectric ring 112 provides structural support and dielectric loading, resulting in a size reduction of antenna 100. The dielectric constant (DK) of this dielectric material should be relatively low in order to retain antenna bandwidth, however the DK should be large enough to fulfill the desired requirements for antenna size. Sample materials with a low DK and low losses are the brand GE NORYL of polyphenylene ether and the brand QUESTRA of syndiotactic polystyrene, a glass-filled crystalline polymer based on a styrene monomer.

Ground plane 111 lies in a plane that is generally parallel to ring-shaped radiating element 103, and ground plane 111 may be provided by a PCB whose lower surface is metallized to provide ground plane 111.

The second sub-volume of antenna assembly 100 is a cylindrical void that is defined by the ID of dielectric ring 112. This second sub-volume provides space in which to mount electronic components (not shown) that are associated with antenna assembly 100. In accordance with a feature of the invention, the top surface of this second sub-volume includes the above-mentioned two centrally-located and half-octagonal metal shields 104 and 105 that are electrically connected to ground plane 111 and that operate to RF-shield electronic components that are contained within this second sub-volume at a location that is under metal shields 104, 105. In an embodiment of the invention the two metal shields 104, 105 where generally coplanar and occupied a plane that was under the plane of metal disk 122, generally parallel to disk 122 and ground plane 111.

The third sub-volume of antenna assembly 100 is a mid-located and cylindrical shaped volume that includes a portion of the above-described second sub-volume. The bottom surface of this third-sub-volume contains metal ground plane 111, its center includes the two metal monopole radiating elements 120 and 121 that extend generally perpendicular to ground plane 111 and are electrically isolated from ground plane 111, and its upper surface contains the metal loading disk 122 that is electrically connected to the top end of the two metal monopole elements 120 and 121.

While two monopole elements 120, 121 are shown in FIG. 4, other monopole configurations, including the use of one monopole element, are within the spirit and scope of the invention.

Rectangular cutouts 130 are provided on the outer circumference of the ring antenna's radiating element 103, these cutouts operating as mode separators that lower the capacitance of one of the antenna $TM_{21}$ modes and raises that mode's resonant frequency. By breaking the degeneracy of the two $TM_{21}$ antenna modes, CP radiation is generated.

Note that the two RF-shields 104, 105 are placed inside of ring-shaped radiating element 103, at a location whereat the E-fields from ring-shaped radiating element 103 are not strong. Thus, ground plane 111 is effectively raised to the plane that is occupied by RF-shields 104, 105 in this E-field-empty region of antenna assembly 100 without impacting bandwidth or efficiency.

With reference to an optimal physical size or area for ground plane 111, antenna 100 with its built-in metal base or ground plane 111 performs well in free space, and when antenna 100 is associated with a much larger area ground plane.

Although a $TM_{21}$ antenna generally requires a ground plane of some sort, a very small-area ground plane is generally better than an infinite-area ground plane. For satellite reception, a small-area ground plane stops backlobe radiation sufficiently, and provides better radiation at 20 degrees, when compared to an infinite-area ground plane. An infinite-area ground plane generally prohibits CP radiation along the horizon. However, a ground plane should be either small (generally less than about 115 mm diameter) or large (generally greater than about 305 mm diameter) so as to not adversely affect terrestrial gain.

In an embodiment of the invention TM21 antenna 100 of FIG. 4 had an OD of about 76 mm. When this antenna was mounted on a non-conductive surface, a ground plane 111 having an OD of about 115 mm was used. Use of this size ground plane 111 provided minimal backlobes and good 20-degree radiation for a satellite pattern. This 115 mm diameter ground plane also provided adequate terrestrial gain at the horizon, which usually requires either a much smaller ground plane or a much larger ground plane. A moderately larger ground plane (for example about 153 mm diameter) reduces the terrestrial gain by an additional 2 dB. However, when the diameter of the ground plane is very large, this terrestrial gain recovers.

That is, antenna in accordance with this invention are associated with either a large-area metal ground plane, for example the 1 meter or so area of the metal roof of an automobile, or the antenna include a built-in metal ground plane or metal base that is about 100 mm in diameter, an example utility of such a built-in-metal-base/ground-plane antenna being for mounting on the plastic dashboard of an automobile.

The dimensional area of such a built-in metal ground plane or base is chosen such that the antenna's radiation patterns are good, and such that a large-area ground plane is not required. The use of only a moderately larger area or diameter ground plane may negatively affect the antenna radiation patterns when the antenna is mounted on a plastic member. Thus the diameter of a built-in ground plane should be chosen with care, for example from about 100 to about 115 mm. Of course, the antenna's radiation patterns are also acceptable when such an antenna is used with a very large-area or large-diameter ground plane, since it is only what might be called intermediate-area ground planes that can provide a problem.

The built-in metal ground plane 111 shown in FIG. 4 provides an effective ground plane for antenna 100 when antenna 100 is mounted on a plastic member such as the dashboard of an automobile, and when antenna 100 is mounted on the large metal surface that is provided by the top of an automobile, this metal automobile surface provides an effective ground plane for the antenna.

As will be described relative to FIG. 11, when an antenna in accordance with this invention is to be mounted on a unknown surface, for example a metal surface of the above-mentioned intermediate-size, a can-shaped metal pedestal 400 is provided as the base of the antenna. Metal pedestal 400 elevates the antenna above the surface 410 that the antenna is mounted on, and the size of pedestal 400 provides the antenna with a ground plane that is of a desired small-size in virtually all antenna mounting conditions.

Figure 5:
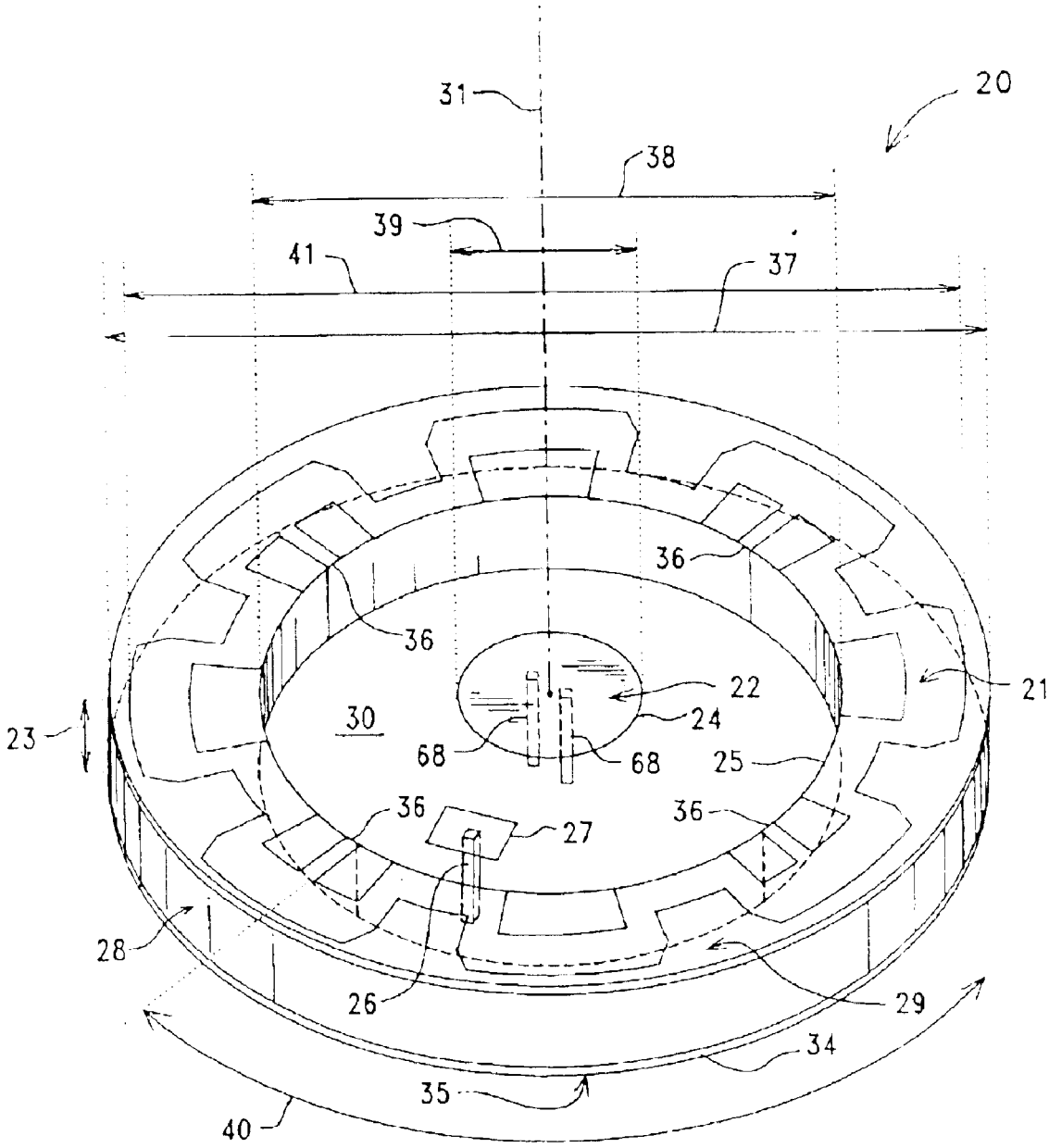
FIG. 5 shows a disk-shaped, two-antenna assembly in accordance with the invention that includes a CP ring antenna of a given height and a linear monopole antenna that is located concentrically within ring antenna and is of generally the same given height, wherein the ring antenna's radiating element comprises a narrow-trace meanderline metal pattern.

FIG. 5 shows a disk-shaped, two-antenna assembly 20 that is constructed and arranged in accordance with the invention wherein antenna assembly 20 having a height 23. Antenna assembly 20 includes a first CP ring antenna 21 and a second linear monopole antenna 22 that is located concentrically within ring antenna 21 and that has a height 23.

Antenna assembly 20 occupies a thin disk-shaped or cylindrical volume having a central axis that is shown at 31, a height that is shown at 23 and an OD that is shown at 37. This overall cylindrical volume 23/37 can be divided into three sub-volumes.

More specifically, the overall cylindrical volume 23/37 that is occupied by antenna assembly 20 includes (1) a ring-shaped sub-volume that is occupied by ring antenna 21 whose height is shown at 23, whose OD is shown at 37, and whose ID is shown at 38, (2) a cylindrical sub-volume that is occupied by monopole antenna 22 whose height is shown at 23 and whose OD is shown at 39, and (3) a ring-shaped void or opening sub-volume 30 having a height shown at 23, having an OD shown at 38, and having an ID shown at 39. Non0limitang example dimensions are about 9 mm for height 23, about 70 mm for OD 37, about 46 mm for ID 38, and about 18 mm for diameter 39.

Ring antenna 21 can be characterized as a relatively narrow-trace meanderline metal ring antenna. Monopole antenna 22 can be characterized as a terrestrial top-loaded metal disk monopole antenna that is shunt matched. Monopole antenna 22 includes two metal posts 68, and monopole antenna 22 is top-loaded by a metal disk 24 in order to provide capacitive loading, thus aiding in reducing the height 23 of antenna assembly 20.

While monopole antenna 22 is shown as having two metal posts 68 that support metal disk 24 and are spaced at generally equal distances on opposite sides of the central axis 31 of antenna assembly 20, it is within the spirit and scope of this invention to provide other metal monopole post configurations to support metal disk 24. For example, the two metal posts 68 shown in FIG. 5 can be replaced by one metal post that extends generally coincident with axis 31 and that supports metal disk 24 on the top end thereof.

In the FIG. 5 embodiment of the invention, ring antenna 21 was formed in the shape of a narrow-trace, meandering or zig-zag, metal resonant ring 25 having four generally identical 90 degree sections, one 90 degree section of which is identified by dimension 40.

The behavior of ring 25's electrical resonance can be described as a transverse magnetic mode with a standing wave of two wavelengths around resonant ring 25 (i.e., the $TM_{21}$ mode).

Ring antenna 21 and monopole antenna 22 both radiate in a conical radiation pattern (not shown), with the axis 31 of the conical pattern extending generally perpendicular to the planar top surface 29 of antenna assembly 20 that contains both metal resonant ring 25 and metal disk 24.

A minimal amount of dielectric material surrounds monopole antenna 22 in order to provide antenna 22 with a large bandwidth. That is, the generally cylindrical and open ring-shaped space 30 that is internal of ring antenna 21 and that surrounds monopole antenna 12 is air in this embodiment of the invention.

The top-loading metal disk 24 of monopole antenna 22 is generally coplanar with the resonant metal ring 25 of ring antenna 21. As stated above, in this embodiment of the invention resonant ring 25 is tuned for the $TM_{21}$ mode of operation, and resonant ring 25 is fed by a metal feed post 26 and its series-connected capacitor 27.

Ring antenna 21 is dielectrically loaded to reduce its physical size by positioning a low-dielectric plastic or dielectric ring 28 under resonant ring 25. As with ring antenna 21, plastic ring 28 has a height shown at 23, an OD shown at 37, and an ID shown at 38. The top planar surface of plastic ring 28 serves as a mechanical support for a ring-shaped and top-located dielectric substrate 29 that carries metal ring 21. Plastic ring 28 is shown as having four 90 degree segments, however plastic ring 28 can be formed as a single structural member.

Mechanical support for feed post 26, metal monopole posts 68, and for a metal ground plane 35 is provided by a PCB 34 having a bottom surface 35 that cooperates with a metal ground plane for use by both CP ring antenna 21 and monopole antenna 22.

The OD 41 of metal resonant ring 25 is reduced by providing ring 25 in the form of a meanderline, as shown. This metal meanderline, which provides for the $TM_{21}$ mode of operation of ring antenna 21, has a sine wave type of octagonal symmetry due to the nature of the $TM_{21}$ mode of operation. Each of the $TM_{21}$ modes of operation contributes a standing wave of four dipoles that extend around the 360-degree circumference of metal resonant ring 25. When both orthogonal $TM_{21}$ modes are excited, to thereby generate CP, eight standing wave dipole currents flow on metal resonant ring 25.

The metal feed post 26 for ring antenna 21 is physically positioned at the middle between the peaks of two orthogonal modes. Hence, feed 26 excites both $TM_{21}$ modes with equal amplitude. Any degeneracy that may exist between the two $TM_{21}$ modes is broken by providing four 90-degree spaced metal perturbations or "mode separators" 36 within the metal meanderline that makes up resonant ring 25.

In FIG. 5 each metal perturbation 36 places a capacitance at the peak, or antinode, of the electric field of that perturbation mode. That is, capacitance is placed where no current flows, and consequently the resonant frequency decreases.

Perturbations 36 also affect the orthogonal mode, thus causing a reduced inductance because peak currents flow at the position of each perturbation 36 for its orthogonal mode. Hence, the resonance frequency of that perturbation's orthogonal mode increase. The two orthogonal modes then resonate at different frequencies, this being a necessary condition for self-resonant CP.

One metal mode separator 36 is located at each of the four electric field peaks of one of the orthogonal modes. This construction and arrangement preserves the symmetry of CP ring antenna 21 and provides symmetrical radiation patterns for CP ring antenna 21.

The metal resonant ring 25 of ring antenna 21 and the metal top-loading disk 24 of monopole antenna 22 are generally coplanar (i.e., both have generally the same height 23) in order to provide optimal bandwidth for both antenna. Thus, each of the two antenna 21 and 22 have the largest possible physical size within a given height 23 of the low profile antenna assembly 20.

One advantage of FIG. 5's coplanar geometry is that antenna assembly 20 and its RF electronics (not shown) can share the same annular space or opening 30. That is, the antenna's electronic components can be placed on the top surface of PCB 34 and within the annular space 30, thus preserving a low profile 23 for antenna assembly 20 and its RF electronic components.

Other antenna, such as patch antenna, require that the antenna's RF electronics be placed under the antenna's ground plane, and hence the overall height of the antenna is increased. Thus, other antenna provide less potential for a low physical profile, and have less bandwidth than does the present invention.

The above-described FIG. 4 wide-trace embodiment of the invention has certain advantages when compared to the above-described FIG. 5 narrow-trace embodiment of the invention.

The gain from the wide-trace ring 103 of FIG. 4 peaks at a lower elevation angle than the gain from the narrow-trace ring of FIG. 5. More specifically, the wide-trace ring 103 of FIG. 4 provides more gain closer to the horizon because only the E fields around the OD of wide-trace ring 103 contribute to radiation from wide-trace ring 103. In addition, wide-trace ring 103 is relatively easy to feed because a low impedance feed point, typically about from 50 to 100 ohms, can be found by moving FIG. 4's feed post 135 radially inward toward the ID of wide-trace ring 103.

The narrow-trace ring 21 of FIG. 5 has less gain closer to the horizon because the E fields around its OD and the opposite E fields around its ID both contribute to radiation. Radiation from the opposite E fields tend to cancel radiation from the E fields around the OD (for example, see MICROSTRIP ANTENNA DESIGN HANDBOOK, R. Garg, P. Bhartia, I. Bahl, and A. Ittipiboon, Chapter 5, Artech House). This radiation-cancellation is more dominant along the horizon. Hence gain from narrow-trace ring 21 of FIG. 5 peaks at a higher elevation angle than does the gain from a wide-trace ring. In addition, a narrow-trace ring such as 21 of FIG. 5 may be more difficult to feed due to its high impedance.

Figure 6A:
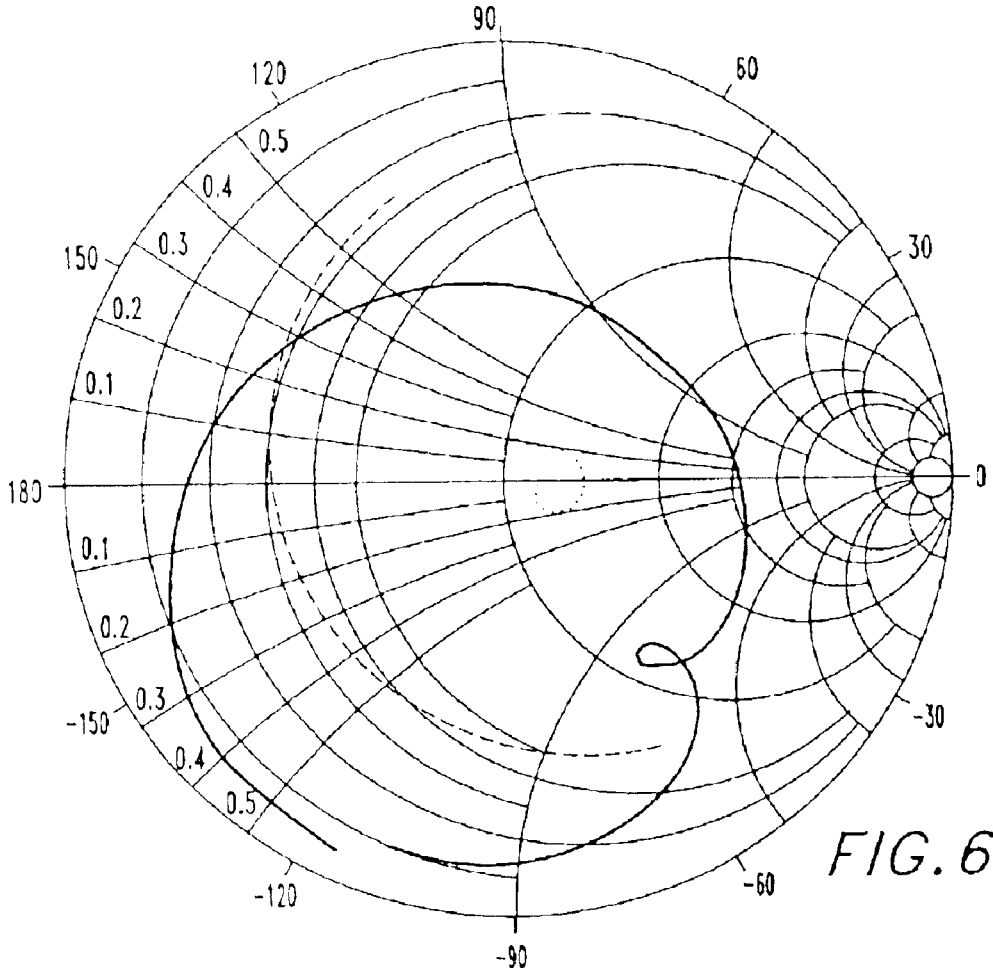
FIGS. 6A and 6B respectively show the S-parameters versus frequency and the Smith chart of the FIG. 5 two-antenna assembly.
Figure 6B:
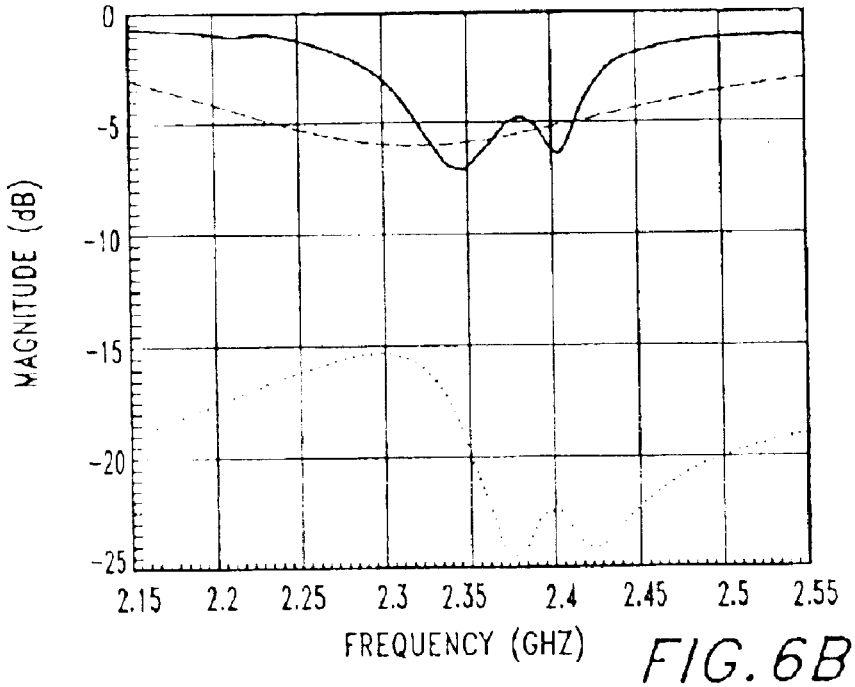

FIGS. 6A and 6B, respectively, show the S-parameters versus frequency and the Smith chart of FIG. 5's two-antenna assembly 20.

The CP frequency is indicated by a notch or tight loop in the FIG. 6B Smith chart. At $TM_{21}$ resonance, coupling between ring antenna 21 and monopole antenna 22 decreases due to cancellation of the fields in the center 31 of ring antenna 21 at the resonance frequency.

Figure 7A:
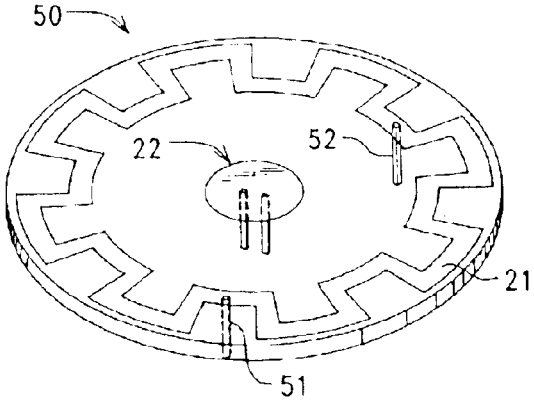
FIGS. 7A and 7B show an embodiment of the invention that is similar to FIG. 5 wherein a two-antenna assembly includes two metal feeds for the ring antenna in order to generate CP excitation.
Figure 7B:
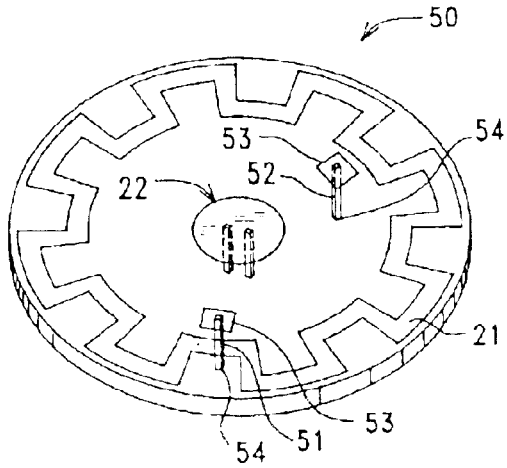

FIGS. 7A and 7B show an embodiment of the invention wherein a two-antenna assembly 50 includes two metal feeds 51 and 52 for ring antenna 21 in order to generate CP excitation. The two feeds 51 and 52 are physically placed so as to excite one of the antenna's orthogonal, degenerate, $TM_{21}$ modes. As stated above, each mode has a peak in the electric field with a periodicity of every 90 degrees around ring antenna 21. Hence, there is a null in the excited mode at 45 +/−n*90-degrees from each of the two feed points 51/52. The second orthogonal mode is excited in one of these nulls in the first orthogonal mode, and the phase is +/−90-degrees in order to generate CP. In FIGS. 7A and 7B the two metal feeds 51/52 are physically separated by about 135 degrees of ring antenna 21. The input impedance of ring antenna 21 at resonance is over 500 ohms, thus the FIG. 7A configuration requires that a matching circuit (not shown) be connected in circuit with each of the two feed posts 51/52.

FIG. 7B provides a capacitance 53 that is connected between each of the two metal feed posts 51/52 and ring antenna 21. This configuration reduces the input impedance at the base 54 of each of the two feed posts 51/52, thus a less reactive matching circuit is required in the FIG. 7B configuration.

Figure 8A:
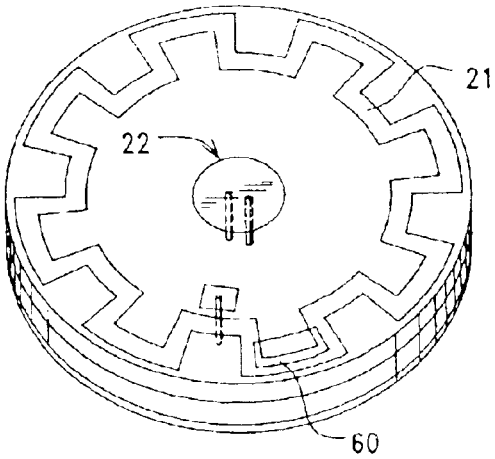
FIGS. 8A and 8B show other techniques in accordance with the invention for applying metal perturbations to the CP ring antenna in order to generate self-resonance in the absence of an externally-located quadrature feed network.
Figure 8B:
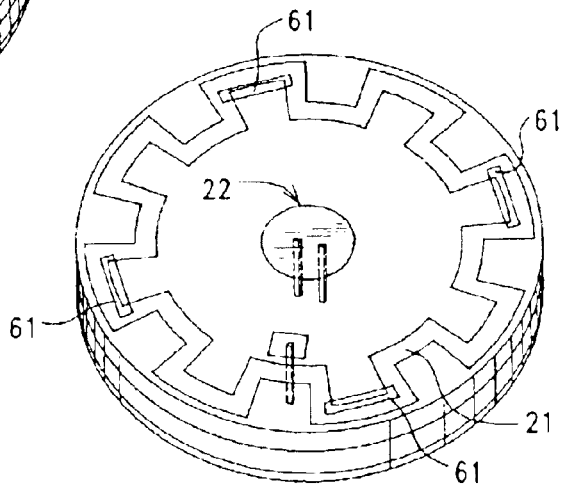

FIGS. 8A and 8B show other techniques for applying metal perturbations to CP ring antenna 21 in order to generate self-resonance in the absence of an externally-located quadrature feed network. The single mode metal perturbation 60 shown in FIG. 8A is placed at one peak in the electric field, and as a result, degeneracy between the modes is broken. When a number of metal mode perturbations are used, for example, but not limited to, four mode perturbations 61 as is shown in FIG. 8B, each of the four metal perturbations 62 can be smaller in physical size than the single metal perturbation 60 of FIG. 8A. As a result, the radiation pattern of ring antenna 21 of FIG. 8B is more symmetric.

Figure 9:
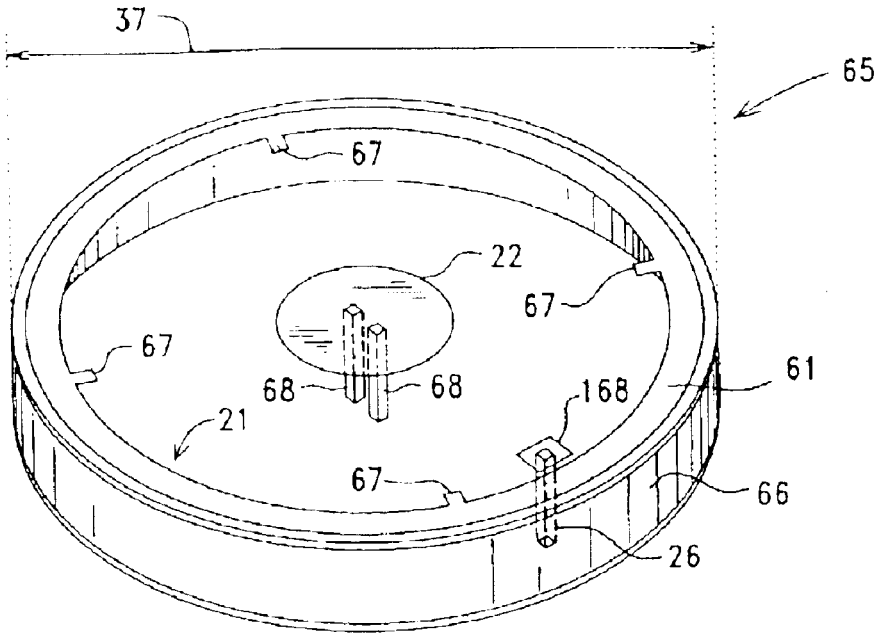
FIG. 9 shows an embodiment of the invention wherein a two-antenna assembly includes a monopole antenna and a ring antenna having a relatively narrow-trace metal ring in the form of a circle for producing the $TM_{21}$ mode of operation.

FIG. 9 shows an embodiment of the invention wherein a two-antenna assembly 65 in accordance with the invention includes the above-described monopole antenna 22 and a ring antenna 21 that includes a narrow metal ring 61 in the form of a circle for producing the $TM_{21}$ mode of operation. That is, metal ring of 61 is not a meandering metal line as is shown at 21 in FIG. 5.

Circular metal ring 61 of FIG. 9 requires more dielectric loading, and this dielectric loading is provided by a dielectric ring 66. This construction and arrangement achieves the same small OD 37 for antenna assembly 65 that is achieved by antenna assembly 20 of FIG. 5.

Ring antenna 21 of FIG. 9 includes four metal perturbations 67 that are physically located at 90 degrees, and that operate in the manner of the four above-described metal perturbations 36 of FIG. 5. In addition, monopole antenna 22 of FIG. 9 includes two metal posts 68 as shown in FIG. 5, and ring antenna 21 includes one metal feed post 26 and a capacitive element 168.

Figure 10:
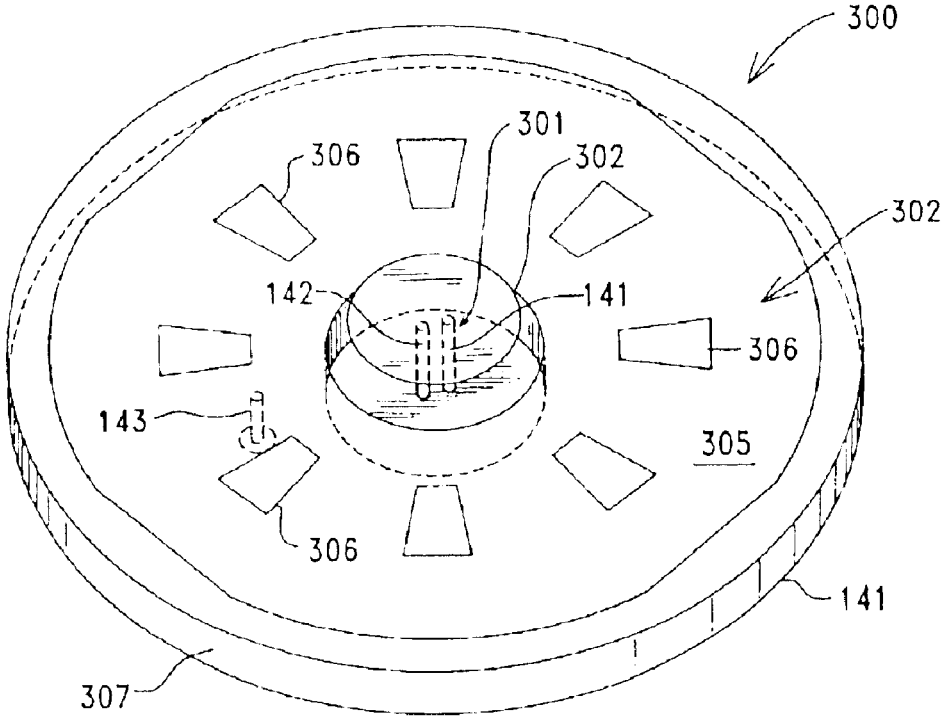
FIG. 10 shows an embodiment of the invention wherein a two-antenna assembly includes a centrally-located monopole antenna and a relatively wide $TM_{21}$ solid-patch ring antenna, wherein the top metal disk of the monopole antenna can be placed coplanar with the radiating element of the ring antenna, or wherein the top metal disk of the monopole antenna can be located above the plane of the radiating element of the ring antenna as shown, and wherein cutouts are provided in the assembly's dielectric member to selectively provide inductive loading of the ring antenna.

FIG. 10 shows another multi-layer embodiment of a dual channel satellite antenna in accordance with the invention wherein a two-antenna assembly 300 includes a generally centrally-located monopole antenna 301 and a $TM_{21}$ solid-patch wide-ring antenna 302, wherein the top disk 302 of monopole antenna 301 can be placed coplanar with the ring-shaped radiating element 305 of ring antenna 302, or wherein the top metal disk 302 of monopole antenna 301 can be located above the plane of ring-shaped radiating element 305 as is shown in FIG. 10, and wherein a number of generally evenly spaced cutouts 306 are provided in the assembly's disk-shaped dielectric member 307 to selectively provide inductive loading of ring antenna 302.

That is, instead of providing a coplanar $TM_{21}$ ring-shaped radiating element and a monopole radiating element, as above-described, the FIG. 10 embodiment provides a monopole radiating element that either extends higher than the ring-shaped patch 305, or the top of the monopole radiating element may be coplanar with the ring-shaped patch 305.

In this FIG. 10 embodiment of the invention a PCB 141 is provided to support both a wide ring-shaped patch 305 and two metal monopole post 141 and 142, and feed to wide ring-shaped patch 305 is provided by way of metal feed post 143. An advantage of using this FIG. 10 embodiment of the invention is that the input impedance of ring-shaped patch 305 is easy to tune merely by placing its feed point 143 close to the middle of patch 305, where the impedance of patch 305 is lower.

Wide ring-shaped radiating element 305 approximates a patch radiating element due to its relatively large width. For example in an embodiment of the FIG. 10 invention wherein the OD of antenna assembly 300 was about 85 mm, the width of ring-shaped radiating element 305 was about 80 mm, and the above-mentioned brand NORYL (DK of about 2.6) was used to form dielectric ring 307, to thereby provide dielectric loading.

The above-described antennas and antenna assemblies can be manufactured in various manners including, but not limited to, insert molding, two-shot molding, and by the use of an etched PCB and stamped metal parts.

One application for an antenna in accordance with the invention is to mount the antenna on the fiberglass top of a vehicle such as a truck. When this antenna has about a 112 mm diameter ground plane, the antenna will work better at low elevations than an antenna that is mounted on the large metal top of a conventional automobile, due to the ground plane effects above-discussed.

Another application for antenna in accordance with the invention is to mount the antenna on an automobile's front-located plastic dashboard, which mounting-location usually does not provide a ground plane effect. It is worth noting that such a dashboard-mounted antenna generally does not provide an omni-directional radiation pattern, and as a result, radiation out of the back of the automobile suffers. Thus, one antenna can be placed on the dashboard, a second antenna can be placed at the back of the automobile, and a diversity algorithm can be used. This above two-antenna configuration tends to guarantee good satellite reception for an automobile having internal antenna.

Considering 20-degree elevation gain in the northern states of the U.S., when a large-area ground plane is used the gain of the above-described $TM_{21}$ antennas has a steep roll-off at 20 degrees above the horizon, which effect can impact reception in the northern states of the US. However, this low elevation gain is improved by placing the $TM_{21}$ antenna on a metal pedestal.

Figure 11:
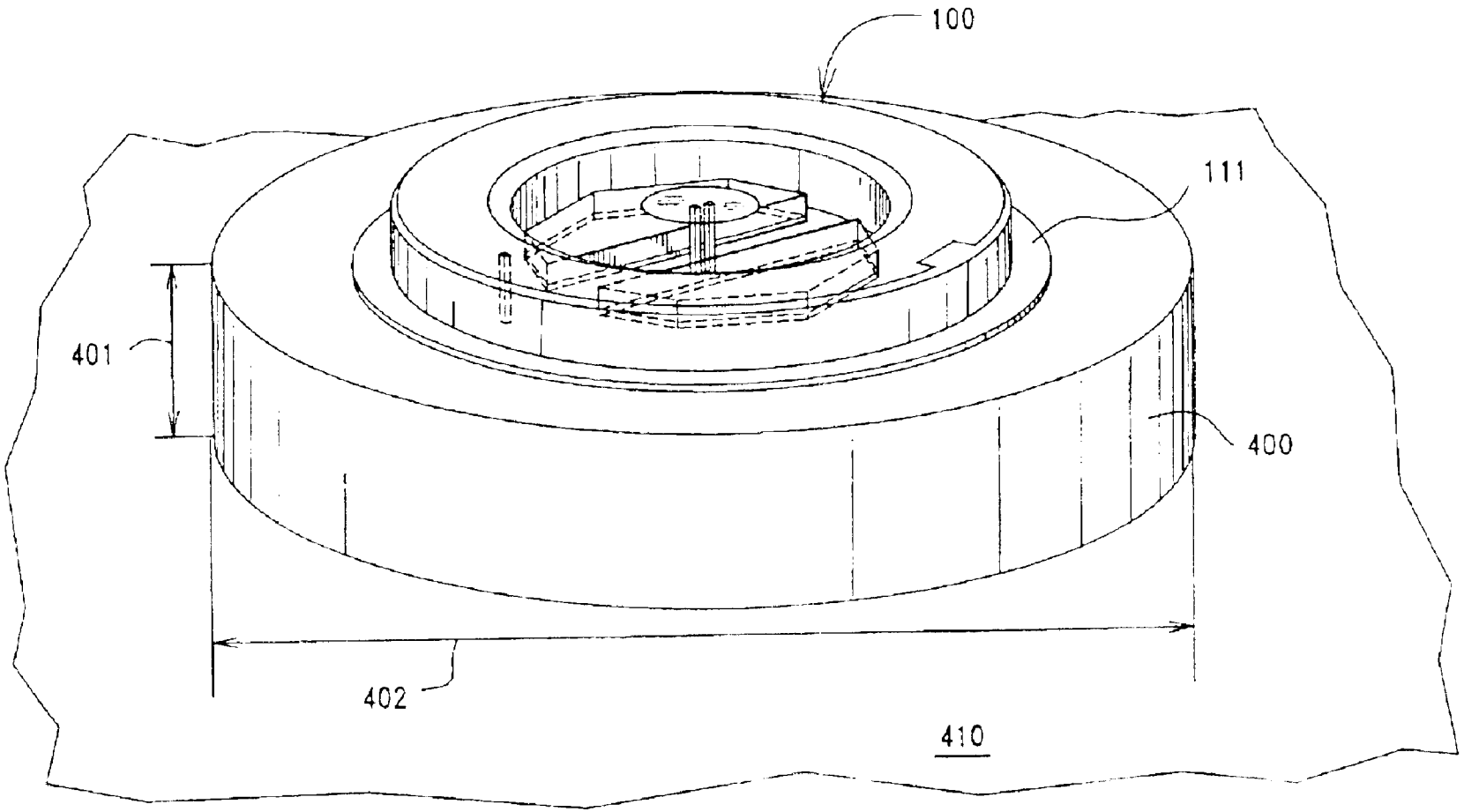
FIG. 11 shows an embodiment of the invention wherein the antenna of FIG. 4 is placed on a metal pedestal that acts as ground plane for the antenna, this metal pedestal being used when the antenna is placed, for example, on the metal roof of an automobile.

FIG. 11 shows an embodiment of the invention wherein antenna 100 of FIG. 4 is placed on the top of a disk-shaped or cylindrical-shaped metal pedestal 400 that provides an optimum-size ground plane for antenna 100. Generally speaking, FIG. 11 provides a metal pedestal/can 400 that is placed under antenna 100 which assembly is then mounted on a very large area metal ground plane, for example a metal automobile roof 410. Usually the FIG. 11 assembly of antenna 100 and pedestal/can 400 would be used when there is a large-area ground plane 410 directly under assembly 100/400.

Without limitation thereto, in the FIG. 11 embodiment of the invention metal pedestal 400 had a height 401 of about 20 mm and a diameter 402 of about 112 mm. In this embodiment of the invention, both large satellite gain and large terrestrial gain are achieved at lower elevation angles, this being of a particularly advantage in northern states such as Maine and Washington.

Metal pedestal 400 operates to increase the height of antenna 100 by about 20 mm. However the reception of antenna 100 is about 3 dB better, and from a performance standpoint the pattern of $TM_{21}$ antenna 100 on metal pedestal 400 is about 1 Db better than that of a tall quadrifiller antenna at 20 degrees.

The terrestrial pattern of antenna 100 on metal pedestal 400 is also very good, with the antenna's terrestrial gain being increased by about 2 dB at the horizon.

Because antenna 100 is ground-plane-dependent, the antenna's radiation pattern can be modified by using small-diameter/area metal ground planes and/or metal pedestals such as pedestal 400. Hence, antennas can be customized for inside-the-car or outside-the-car applications. Quadrifillar antenna can not provide this feature because they are not ground plane dependent.

A crossed dipole antenna is ground plane dependent, and placing such an antenna on a metal pedestal would likely exaggerate the cardioid dip at the zenith of its radiation pattern. However, such a pedestal-mounted cross dipole antenna would be taller than the embodiment of FIG. 11. Also, the use of a small ground plane will make the crossed dipole pattern of such an antenna more directional toward the zenith.

Thus, the constructions and arrangements of embodiments of the present invention provide a distinct advantage wherein the antenna's ground plane can be treated as a design variable.

What is claimed is:

1. A disk-shaped two-antenna assembly, comprising:

a dielectric ring having an outer diameter, an inner diameter, a ring-shaped and generally planar top surface, and a ring-shaped and generally planar bottom surface that is generally parallel to said ring-shaped top surface;

a disk-shaped metal ground plane associated with said ring-shaped bottom surface of said dielectric ring;

a ring-shaped metal radiating element abutting said ring-shaped top surface of said dielectric ring;

a linear metal radiating element;

said linear radiating element having a bottom end associated with and insulated from said disk-shaped ground plane at a location that is generally concentric with said disk-shaped ground plane;

said linear radiating element having a top end occupying a plane that is either common with a plane that is occupied by said ring-shaped metal radiating element or is above said plane occupied by said ring-shaped metal radiating element;

first antenna feed means connected to said ring shaped metal radiating element; and second antenna feed means connected to said generally linear metal radiating.

2. The two-antenna assembly of claim 1 including:

a disk-shaped printed circuit board associated with said ring-shaped bottom surface of said ring-shaped dielectric ring;

said metal ground plane being located on a bottom surface of said printed circuit board.

3. The two-antenna assembly of claim 1 including:

a metal disk concentrically mounted on said top end of said linear metal radiating element;

said metal disk having a diameter that is less than said inner diameter of said dielectric ring; and said metal disk occupying a plane that is generally parallel to said ground plane.

4. The two-antenna assembly of claim 1 including:

at least one metal perturbation connected to said ring-shaped metal radiating element.

5. The two-antenna assembly of claim 1 including:

four metal perturbations connected to said ring-shaped metal radiating element;

said four metal perturbations being located at 90 degree intervals about a circumference of said ring-shaped metal radiating element.

6. The two-antenna assembly of claim 1 wherein said ring-shaped metal radiating element is a relatively narrow ring-antenna radiating element metal line that meanders back and forth across said ring-shaped top surface of said dielectric ring.

7. The two-antenna assembly of claim 1 wherein said ring-shaped metal radiating element is a relatively narrow ring-antenna radiating element that forms a circle on said ring-shaped top surface of said dielectric ring.

8. The two-antenna assembly of claim 1 wherein said ring-shaped metal radiating element is a relatively wide ring-antenna radiating element that forms a circle on said ring-shaped top surface of said dielectric ring.

9. The two-antenna assembly of claim 1 wherein said ring-shaped metal radiating element is a wide patch-antenna radiating element that forms a circle on said ring-shaped top surface of said dielectric ring.

10. The two-antenna assembly of claim 1 including:

a plurality of voids formed in said dielectric ring.

11. The two-antenna assembly of claim 1 including:

an electrically reactive element connecting said first metal antenna feed means to said ring shaped metal radiating element.

12. The two-antenna assembly of claim 1 wherein said ring antenna is a CP antenna, and wherein said ring-shaped metal radiating element comprises a ring-shaped metal line that meanders back and forth across said ring-shaped top surface of said dielectric ring to form four generally identical 90 degree long sections that support an electromagnetic wave having a length of two wavelengths that extend about the 360 degree circumference of said ring-shaped metal line.

13. The two-antenna assembly of claim 12 including:

four metal perturbations associated with said ring-shaped metal line;

said four metal perturbations being located at 90 degree intervals about said ring-shaped metal line.

14. The two-antenna assembly of claim 13 including:

a metal disk concentrically mounted on said top end of said linear metal radiating element so as to occupy a plane that is generally common with said ring-shaped metal radiating element;

said metal disk having a diameter that is less than said inner diameter of said dielectric ring.

15. The two-antenna assembly of claim 14 including:

at least one electrically reactive element connecting said first metal antenna feed means to said ring shaped metal radiating element.

16. The two-antenna assembly of claim 15 wherein said metal ground plane is carried by a bottom surface of a printed circuit board.

17. The two-antenna assembly of claim 16 wherein said two feed connections are physically spaced by about 135 degrees.

18. The two-antenna assembly of claim 12 wherein said first metal antenna feed means comprises two feed connections to said ring shaped metal line, said two feed connections being physically spaced about said ring shaped metal line in a manner to generate CP excitation of said ring shaped metal line.

19. The two-antenna assembly of claim 1 wherein a diameter of said disk-shaped ground plane is about 20 percent greater than a diameter of said dielectric ring.

20. The two-antenna assembly of claim 1 wherein said disk-shaped metal ground plane is formed by a top surface of a metal pedestal.

21. The two-antenna assembly of claim 20 wherein a diameter of said top surface of said metal pedestal is about 20 percent greater than a diameter of said dielectric ring.

22. A method of making a low profile two-antenna assembly that contains a ring antenna and a linear monopole antenna, said two-antenna assembly being in the shape of a disk having a central axis, a diameter and a thickness, the method comprising the steps of:

providing a ring-shaped dielectric member having an inner diameter, an outer diameter that is generally equal to said diameter of said two-antenna assembly, a ring-shaped top planar surface that extends generally perpendicular to said central axis of said two-antenna assembly, a ring-shaped bottom planar surface that extends generally parallel to said ring-shaped top planar surface, and a thickness that is generally equal to said thickness of said two-antenna assembly;

providing a circular metal radiating element on said top surface of said ring-shaped dielectric member;

providing a linear metal radiating element having a top end, a bottom end, and a length that is at least equal to said thickness of said two-antenna assembly; and mounting said linear metal radiating element generally coincident with said central axis of said two-antenna assembly, with said bottom end generally coincident with said bottom surface of said ring-shaped dielectric member.

23. The method of claim 22 wherein said thickness of said two-antenna assembly is smaller than said diameter of said two-antenna assembly.

24. The method of claim 22 including the step of:

providing a disk-shaped metal ground plane having a diameter that is at least equal to said diameter of said ring-shaped dielectric member associated with said bottom surface of said ring-shaped dielectric member.

25. The method of claim 24 including the steps of:

providing a thin and disk-shaped dielectric member intermediate said ground plane and said bottom surface of said ring-shaped dielectric member; and mounting said bottom end of said linear metal radiating element on said dielectric member.

26. The method of claim 22 including the step of:

providing pedestal having a top metal surface associated with said bottom surface of said ring-shaped dielectric member.

27. The method of claim 22 including the steps of:

providing a thin metal disk having a center and a diameter that is no greater than said inner diameter of said ring-shaped dielectric member; and mounting said metal disk on said top end of said linear metal radiating element such that said center of said metal disk is generally coincident with said center axis of said two-antenna assembly.

28. The method of claim 22 including the step of:

providing said circular metal radiating element as a narrow ring-antenna radiating element that meanders back and forth across said top surface of said ring-shaped dielectric member.

29. The method of claim 22 including the step of:

providing said circular metal radiating element as a narrow ring-antenna radiating element that forms a circle on said top surface of said ring-shaped dielectric member.

30. The method of claim 22 including the step of:

providing said circular metal radiating element as a wide ring-antenna radiating element that forms a circle on said top surface of said ring-shaped dielectric member.

31. The method of claim 22 including the step of:

providing said circular metal radiating element as a wide patch-antenna radiating element that forms a circle on said top surface of said ring-shaped dielectric member.

32. The method of claim 31 including the step of:

forming inductive-loading voids in said ring-shaped dielectric member.

33. The method of claim 31 including the steps of:

providing a thin metal disk having a center and a diameter that is no greater than an inner diameter of said circle; and mounting said metal disk on said top end of said linear metal radiating element such that said center of said metal disk is generally coincident with said center axis of said two-antenna assembly.

34. The method of claim 33 including the step of:

providing a thin disk-shaped dielectric member intermediate said disk-shaped metal ground plane and said bottom surface of said ring-shaped dielectric member.

35. The method of claim 34 wherein said thickness of said two-antenna assembly is smaller than said diameter of said two-antenna assembly.

36. The method of claim 22 wherein said circular metal radiating element is a CP ring-antenna radiating element, including the step of:

providing said CR ring-antenna radiating element as a metal pattern that meanders back and forth across said top surface of said ring-shaped dielectric member to form four generally identical 90 degree long metal pattern sections for support of an electromagnetic wave having a length of two wavelengths extending around said metal pattern.

37. The method of claim 36 including the step of:

providing four metal perturbations connected to said metal pattern; and locating said four metal perturbations at 90 degree intervals about said metal pattern.

38. The method of claim 37 including the step of:

providing a metal disk concentrically mounted on said top end of said linear metal radiating element;

said metal disk having a diameter that is less than said inner diameter of said ring-shaped dielectric member.

39. The method of claim 38 including the step of:

providing at least one electrically reactive element connecting metal antenna feed means to said circular metal radiating element.

40. The method of claim 39 wherein said disk-shaped dielectric member is a printed circuit board.

41. The method of claim 36 including the step of:

providing two feed connections to said circular metal radiating element that are physically spaced about said circular metal radiating element in a manner to generate CP excitation of said circular metal radiating element.

42. The method of claim 41 wherein said two feed connections are physically spaced by about 135 degrees.

43. A two-antenna assembly containing both a CP ring antenna and a linear monopole antenna, said two-antenna assembly being in the shape of a disk having a central axis, a diameter and a thickness that is less than said diameter, the two-antenna assembly comprising;

a ring-shaped dielectric member having an inner diameter, an outer diameter that is generally equal to said diameter of said two-antenna assembly, a ring-shaped top planar surface that extends generally perpendicular to said central axis, a ring-shaped bottom planar surface that extends generally parallel to said ring-shaped top planar surface, and a thickness that is generally equal to said thickness of said two-antenna assembly;

a disk-shaped metal ground plane associated with said bottom surface of said dielectric member, said ground plane having a diameter that is generally equal to said diameter of said ring-shaped dielectric member;

a circular metal radiating element on said top surface of said ring-shaped dielectric member;

said circular metal radiating element for supporting an electromagnetic wave having a length of two wavelengths extending 360 degrees around said top surface of said ring-shaped dielectric member;

a linear metal radiating element having a top end, a bottom end, and a length that is at least equal to said thickness of said two-antenna assembly;

said linear metal radiating element being positioned coincident with said central axis, with said bottom end associated with, but insulated from, said ground plane; and a planar metal disk concentrically mounted on said top end of said linear metal radiating element such that a plane of said disk extends generally perpendicular to said central axis;

a diameter of said disk being less than said inner diameter of said ring-shaped dielectric member.

44. The two-antenna assembly of claim 43 including:

four equally spaced metal perturbations electrically connected to said circular metal radiating element.

45. The two-antenna assembly of claim 44 including:

at least one electrically reactive element connecting an antenna feed means to said circular metal radiating element.

46. The two-antenna assembly of claim 44 including:

two metal feeds connected to said circular metal radiating element;

said two feeds being physically spaced about said ring antenna radiating element in a manner to generate CP excitation of said circular metal radiating element.

47. The two-antenna assembly of claim 46 wherein said two feeds are physically spaced by about 135 degrees.

48. The two-antenna assembly of claim 43 wherein said metal ground plane is a thin and planar metal member.

49. The two-antenna assembly of claim 48 wherein a diameter of said thin and planar metal member is about 20 percent greater than a diameter of said ring-shaped dielectric member.

50. The two-antenna assembly of claim 43 wherein said metal ground plane is a cylindrical-shaped pedestal having a planar top metal surface that forms said metal ground plane.

51. The two-antenna assembly of claim 50 wherein a diameter of said top metal surface is about 20 percent greater than a diameter of said ring-shaped dielectric member.

52. A disk-shaped two-antenna assembly, comprising:

a ring-shaped dielectric member having a central axis, having an outer diameter, having an inner diameter, having a thickness, having a circular top surface that lies in a plane extending generally perpendicular to said central axis, and having a circular bottom surface that lies in a plane extending generally perpendicular to said central axis;

a circular metal ground plane having a peripheral portion thereof associated with said circular bottom surface of said dielectric member;

said ground plane having a diameter that is at least as great as said outer diameter of said dielectric member;

said ground plane and said inner diameter of said dielectric member defining a cylindrical void for the placement of electronic components associated with said two-antenna assembly;

a ring-shaped metal antenna radiating element on said top circular surface of said dielectric member; and a linear metal antenna radiating element located generally coincident with said central axis, having a top end, having a bottom end associated with and electrically insulated from said ground plane, and having a length at least equal to said thickness of said dielectric member.

53. The two-antenna assembly of claims 52 including:

at least two metal shield plates electrically connected to said ground plane and located within an upper portion of said cylindrical void intermediate said ground plane and said top end of said linear antenna radiating element;

said at least two shield plates being physically spaced from said linear antenna radiating element.

54. The two-antenna assembly of claim 53 including:

a metal disk having a center thereof mounted on said top of said linear antenna element, and having a diameter that is no greater than said inner diameter of said dielectric member.

55. The two-antenna assembly of claim 54 wherein said disk occupies a plane generally coincident with said top circular surface of said dielectric member.

56. The two-antenna assembly of claim 54 wherein said disk occupies a plane that is located above said top circular surface of said dielectric member.

57. The two-antenna assembly of claim 52 wherein said ring-shaped metal antenna radiating element includes cutout portions that operate to provide reactive loading.

58. The two-antenna assembly of claim 52 wherein said ring-shaped metal antenna radiating element includes cutout portions that operate as mode separators.

59. The two-antenna assembly of claim 52 wherein said circular metal ground plane is a top metal surface of a cylindrical-shaped pedestal.

* * * * *